US008124549B2

(12) United States Patent
Torres et al.

(10) Patent No.: US 8,124,549 B2
(45) Date of Patent: Feb. 28, 2012

(54) NON-WOVEN FABRIC

(75) Inventors: Manel Torres, London (GB); Paul Luckham, London (GB)

(73) Assignee: Manel Torres, London (GB)

( * ) Notice: Subject to any disclaimer, the term of this patent is extended or adjusted under 35 U.S.C. 154(b) by 840 days.

(21) Appl. No.: 10/517,386

(22) PCT Filed: Jun. 11, 2003

(86) PCT No.: PCT/GB03/02523

§ 371 (c)(1),
(2), (4) Date: Jun. 3, 2005

(87) PCT Pub. No.: WO03/104540

PCT Pub. Date: Dec. 18, 2003

(65) Prior Publication Data

US 2005/0222320 A1 Oct. 6, 2005

(30) Foreign Application Priority Data

Jun. 11, 2002 (GB) ..... 0213368.4

(51) Int. Cl.
*D02G 3/00* (2006.01)
*D04H 1/00* (2006.01)

(52) U.S. Cl. ..... 442/361; 442/335; 428/360; 428/373; 428/375

(58) Field of Classification Search ..... 106/162.5, 106/162.8; 156/180; 264/115, 126, 517; 427/389.9, 392, 385.5, 195, 515; 442/327, 442/335, 361; 523/204, 222; 524/13, 321, 524/40, 503; 528/23; 428/359, 360, 373, 428/375, 378

See application file for complete search history.

(56) References Cited

U.S. PATENT DOCUMENTS

| | | | | |
|---|---|---|---|---|
| 4,092,454 | A * | 5/1978 | Domoto et al. | 442/327 |
| 4,240,936 | A * | 12/1980 | Henning | 524/13 |
| 4,536,430 | A | 8/1985 | Krecke | |
| 5,620,509 | A | 4/1997 | Tampio | |
| 5,684,068 | A * | 11/1997 | Boyer et al. | 524/40 |
| 6,204,350 | B1 * | 3/2001 | Liu et al. | 528/23 |
| 6,217,805 | B1 * | 4/2001 | Brown et al. | 264/115 |
| 2004/0167260 | A1 * | 8/2004 | Chen et al. | 524/321 |

FOREIGN PATENT DOCUMENTS

| | | | |
|---|---|---|---|
| EP | 0083960 | | 1/1983 |
| EP | 0 165 880 | A * | 5/1985 |
| EP | 0165880 | | 5/1985 |
| EP | 0328037 | | 2/1989 |
| JP | 61042373 | A | 8/1984 |
| JP | 05186949 | | 4/1992 |
| JP | 05186949 | A * | 7/1993 |

OTHER PUBLICATIONS

Rosato, D.V. (1998). Extruding Plastics—A Practical Processing Handbook. (pp. 673-698). Springer—Verlag.□□Online version available at: http://www.knovel.com/knove12/Toc.jsp?BookID=332 &VerticalID=0.*

* cited by examiner

*Primary Examiner* — Jenna Johnson
(74) *Attorney, Agent, or Firm* — Whitham, Curtis, Christofferson & Cook, P.C.

(57) ABSTRACT

This invention provides a composition for forming a fabric by spraying onto a supporting surface, the composition comprising fibers, a binder and a diluent. Further aspects of the invention include the fabric formed by spraying the composition and an article comprising the fabric, an apparatus and a method for spraying the composition.

20 Claims, No Drawings

NON-WOVEN FABRIC

FIELD OF THE INVENTION

This invention relates to non-woven fabrics, and in particular to a method of making fabrics by spraying fibres onto a support member, and to a mixture of fibres, binder and diluent for use in the method of the invention.

BACKGROUND

Fabrics are required in a wide variety of applications and industries, including for instance the fashion and furniture industries, as well as being useful in a number of medical applications. Most commonly fabrics are woven fabrics, although it is also known to produce non-woven fabrics. The industries which require fabrics have a need for the provision of fabrics by methods which are flexible and convenient, and in particular methods which allow fabrics to be formed quickly and easily, from a variety of different fabric materials and in a variety of different shapes.

EP-A-083,960 discloses a composition comprising mineral wool and polyolefin fibres. This composition can be sprayed on to ceilings or walls to form a textured acoustical coating. This composition does not enable a fabric to be formed.

U.S. Pat. No. 4,536,430 describes a novel use of leather waste. Pieces of leather are broken down with a solvent to form a mixture which can be spread on the surfaces such as walls, floors or ceilings to create a film.

U.S. Pat. No. 5,620,509 discloses another wall coating mixture comprising cellulose fibres and a cellulose or starch based binder, water and foaming agent. The coating forms a film on walls which resembles plaster.

EP-A-328,037 describes the production of a piled texture material from a composition comprising a film forming polymer and microparticles.

JP 61042373 describes a paint which can be used to give a suede or felt appearance in architectural interiors and the interiors of cars.

None of these disclosures relates to the provision of a fabric, although a number of the disclosures relate to sprayable coatings which contain fibres. The invention, in contrast, is based on the realisation by the inventors that particular combinations of materials can be used to form compositions which can create non-woven fabrics by a simple spraying process. Thus the invention allows provision of non-woven fabrics containing a wide variety of fabric materials, by a simple and straightforward method. The invention allows application of fabric to a wide variety of different surfaces and with almost unlimited scope for the contours of the fabric.

SUMMARY OF THE INVENTION

A first aspect of this invention provides a composition for forming a fabric by spraying onto a supporting surface, the composition comprising fibres, a binder and a diluent.

A second aspect of this invention is an apparatus comprising a container containing the composition of the present invention and a device capable of producing a spray of the composition from the container.

A third aspect of this invention is a non-woven fabric produced by spraying a composition of the present invention, wherein the fabric comprises a solid binder and fibres bound by the binder.

A fourth aspect of this invention is an article comprising a non-woven fabric according to the third aspect of this invention.

A fifth aspect of this invention is a method for producing a non-woven fabric comprising a) placing a composition of the present invention in a container device capable of producing a spray, and
b) spraying the composition from a spray point on the device onto a supporting surface wherein substantially all of the diluent evaporates before the composition reaches the supporting surface thereby forming a non-woven fabric on the supporting surface.

Accordingly the present invention provides a method of spraying fibres, comprising the steps of preparing a composition including at least one diluent, such as a solvent, a binder and fibres; mixing the above components to provide a homogeneous suspension; and spraying the composition with a spray device (such as a two-fluid spray gun, an aerosol can or an artist's air brush) onto a suitable support surface.

The invention also extends to a spray mixture comprising a suspension of small fibres homogeneously mixed in a suitable diluent such as acetone, together with a binder such as a polymer binder. The fibres should be of 'dispersible' dimensions and sufficiently small to flow through the nozzle of a spray device (such as a spray gun, aerosol can or artist's air brush).

DETAILED DESCRIPTION OF THE INVENTION

The fabric of the present invention formed by spraying the composition of the present invention offers possibilities for binding, lining, repairing, layering, covering and moulding items in ways previously not imagined. In the field of clothing for example, applying the fabric of the present invention by spraying to form a pocket or strap could instantly integrate a mobile phone into a jacket. Similarly sleeves could be added to a T-shirt for warmth dispensing with the need for a coat. Old garments could be recycled and updated in an instant. Fabric can be used in place of stitching giving freedom and ease when garments are designed and manufactured.

The "fabric" provided by the present invention is a non-woven textile material which is often felt-like in texture.

The composition of the present invention is sprayed onto a solid "supporting surface". This can for instance be an item to which a piece of fabric is to be added or a mould or other surface from which the fabric, once formed, can be easily separated or peeled away.

Both the composition and the fabric of the present invention comprise "fibres" of fabric material which are slender, elongated structures having an aspect ratio (ratio of length to diameter) of at least 3:1 and preferably at least 5:1, more preferably at least 10:1.

The composition of the present invention comprises a "diluent" which is a liquid, generally an organic solvent or water, in which the other components of the composition are dissolved, suspended or dispersed. The diluent acts as a solvent for the binder and evaporates quickly when the composition is sprayed to form the fabric of the present invention. The diluent may for example be a solvent such as acetone or ethyl acetate.

Both the composition and the fabric of the present invention comprise a "binder" which is solid at ambient temperature and binds the sprayed material together, but is soluble in the chosen diluent thereby preventing the fibres of the composition aggregating before spraying. Hence the binder and the diluent are matched so that they are complementary. The binder may be polymeric, polyvinyl acetate (PVA) being particularly suitable. The binder can be a homopolymer or a polymer of two or more monomers.

The first aspect of this invention is a composition for forming a fabric by spraying onto a supporting-surface, the composition comprising fibres, a binder and a diluent. Generally the binder in the composition of the present invention is a polymer.

It is expected that the binder has a glass transition temperature (Tg) of at least 15° C., preferably at least 20° C., more preferably at least 30° C., most preferably at least 35° C. Also, the glass transition temperature of the binder is expected to be not more than 200° C., preferably not more than 150° C. and more preferably not more than 100° C. If the Tg is too low the binder can have a tendency to form a film in which the fibres are embedded instead of a non-woven fabric. If the Tg is too high the binder will bind the fibres of the fabric into a non-woven fabric, but the fabric has a tendency to be brittle. The molecular weight of the polymer can also be important. Usually the binder has a molecular weight of from 15 000 to 200 000, preferably from 50 000 to 150 000. The molecular weight can be measured by gel permeation chromatography. Preferably the binder is selected from poly vinylacetate, poly vinylbutyrate, natural latex, and polyvinylalcohol. Nylon-nanoclay, polyamide-clay, dendrimers, viscose and silicones can also be used but are less preferred.

The binder must be chosen so that it is capable of binding the fibres together when the composition is sprayed onto a supporting surface but does not cause significant aggregation of the fibres in the composition, before spraying.

The composition of the present invention comprises fibres. The fibres in the composition must be of a certain minimum length. Generally at least 80% of the fibres have a length of at least 0.02 mm. Preferably at least 90%, more preferably at least 95% and most preferably substantially all of the fibres in the composition have a length of at least 0.02 mm.

The fibres of the composition should not be too long since a composition comprising long fibres cannot be sprayed easily because the fibres block a nozzle. Generally, at least 80% (by weight) of the fibres have a length not more than 10 mm, preferably not more than 5 mm, more preferably not more than 1 mm, still more preferably not more than 0.5 mm, even more preferably not more than 0.25 mm, most preferably not more than 0.15 mm. Preferably, at least 90%, more preferably at least 95% and most preferably substantially all of the fibres have a length not more than 10 mm, preferably not more than 5 mm, more preferably not more than 1 mm, still more preferably not more than 0.5 mm, even more preferably not more than 0.25 mm, most preferably not more than 0.15 mm. In a preferred embodiment substantially all the fibres have a length in the range 0.02 to 0.15 mm.

Both synthetic and natural fibres may be used in the composition. Examples of fibres which may be used include:

Cotton fibres
Wool fibres
Silk fibres
Cashmere fibres
Linen fibres
Seaweed cellulose fibres
Ramie cellulose fibres
Mink fur fibres
Rabbit hair fibres
Aramid fibres
Chitosan fibres
Other natural fibres
Carbon fibres
Glass fibres
Metallic fibres e.g., steel, copper, silver etc. . . .
Ceramic fibres Generally the fibres in the composition are at least 10, 20, 30 or 40% (by weight of fibres) polymeric fibres. In a preferred embodiment most of the fibres in the composition are polymeric and organic, even though other fibre types may be used. Thus preferably at least 50, 60, 70 or 80%, especially at least 90%, of the fibres are polymeric. Most preferably only organic, polymeric fibres are used.

For the composition when sprayed to produce a non-woven fabric a sufficient binder to fibre ratio is usually desirable. For example the ratio of binder to fibres is preferably not greater than 5:1, more preferably not greater than 4:1 and even more preferably not greater than 3:1 and is preferably not less than 1:5, more preferably is not less than 1:4 and more preferably is not less than 1:3. Preferably, the ratio of fibres to binder is in the range 5:1 to 1:5, more preferably 3:1 to 1:3, even more preferably 2:1 to 1:2, most preferably 1.5:1 to 1:1.5.

The composition of the present invention comprises a diluent in which the binder is soluble and the fibres and any other components are soluble or dispersed. The diluent is also volatile so that during spraying, the diluent substantially evaporates before the sprayed material arrives at the surface onto which it is sprayed.

Generally, the diluent is selected from water, C 1 to 12 alcohols, ketones and esters, preferably C 1 to 6 alcohols, ketones and esters. Preferably, the diluent is selected from methanol, ethanol, butanol, acetone, ethyl acetate and water. When the diluent used is water preferably the composition additionally comprises a dispersant such as a surfactant to prevent aggregation of the fibres in the composition.

Ideally a diluent is selected which is non-toxic and both environmentally and user friendly.

Preferably, the diluent has a boiling point of not more than 100° C., more preferably not more than 70° C., even more preferably not more than 45° C.

In a preferred embodiment the composition additionally comprises at least one agent selected from adhesive, dye, physiologically active ingredient, fragrance, powder, oil, emulsifying agent and propellant.

For different colours of spray-on fabric, dyed fibres may be used, or small quantities of dye can be added directly to the diluent. Food dyes are particularly suitable, but any dye soluble in the diluent can be used.

For example, if the spray-on fabric is required to adhere to a surface, an adhesive agent may also be incorporated. Adhesives used for spray contact photographic mounting are particularly suitable.

Other materials that could be added to the composition to be sprayed along with the fibres include:

Wood (saw dust)
Feathers
Metallic powders e.g., steel, copper, silver etc. . . .
Titanium dioxide
Nano-silica
Micro/nanocapsules containing:
- Oils: e.g. citronella, eucalyptus, neem etc
- Perfumes
- Drugs
- Vitamins
- Surfactants
- Moisturisers
- Natural antibiotics
- Proteins
- Health & beauty products such as: deodorants and antiperspirants Preferably, at least 75%, 85% or 95% by weight of the total solids in the composition are fibres.

The additional agents must be selected so that the fibres do not aggregate when in the composition. Some agents eg. dispersants such as surfactants may be added to prevent aggregation of fibres in the composition.

Alternatively, these materials may be applied to the sprayed-on fabric.

The choice of binder and other components also has an effect on the viscosity of the composition. If the viscosity is too high the composition will be difficult to spray. Preferably, the composition has a viscosity in the range 10 mPas to 10 Pas, more preferably in the range of 100 mPas to 1 Pas. The viscosity of the composition is measured using a concentric cylinder rheometer (Paar Physica Universal Dynamic Spectrometer [UDS] 200) at a temperature of 25° C.

The skilled person will understand that it is not necessary to use only one type of fibre or diluent or binder in the composition. Blends of more than one fibre may be used and/or diluent may be used and/or blends of more than one binder may be used in the same composition. Additionally if the composition comprises additional agents, one or more additional agents may be used in the same composition.

A second aspect of this invention is an apparatus comprising a container containing the composition of the present invention and a device capable of producing a spray of the composition from the container. Preferably, the device capable of producing a spray has a nozzle with internal diameter of 0.05 to 2 mm, more preferably 0.1 to 1 mm.

A third aspect of this invention is a non-woven fabric produced by spraying a composition of the present invention, wherein the fabric comprises a solid binder and fibres bound by the binder. Generally, the fibres lie substantially in parallel with the plane of the fabric. That is, they lie flat along the plane of the supporting surface on which the fabric is formed rather than perpendicular to the supporting surface.

Preferably, the fibres in the fabric are conjugated and are longer than the fibres in the composition. We believe that the fibres in the fabric are formed from shorter fibres in the composition joined by binder so that they partially overlap. The conjugated fibres are at least 1 mm, preferably 2 mm, more preferably 5 mm, still more preferably 10 mm, even more preferably at least 20 mm, yet more preferably about 50 mm in length.

A fourth aspect of this invention is an article comprising a non-woven fabric according to the third aspect of this invention. Preferably the article is selected from a piece of clothing, furniture or millinery item.

A fifth aspect of this invention is a method for producing a non-woven fabric comprising a) placing a composition of the present invention in a container device capable of producing a spray, and
b) spraying the composition from a spray point on the device onto a supporting surface wherein substantially all of the diluent evaporates before the composition reaches the supporting surface thereby forming a non-woven fabric on the supporting surface.

During spraying the spray should be fine so that the diluent can evaporate from the composition and the fibres are able to conjugate during spraying.

Preferably, the device capable of producing a spray has a nozzle with internal diameter of 0.05 to 2 mm, more preferably 0.1 to 1 mm. This provides the fine spray. Preferably, conjugated fibres form during step b) so that the average length of fibres in the formed non-woven fabric is greater than the average length of fibres in the sprayed composition. Preferably, the spray formed in step b) is a fine spray with droplet size of less than 1 mm.

There are interacting factors which determine the type of fabric produced by spraying the composition of the present invention.

Different diluents can have an effect on the resulting fabric as can changes in the fibre and binder contents as well as the fibres and binders used.

Changes in the distance from the spray point to the supporting surface can lead to differences in the resulting fabric. When the spray point is close to the supporting surface the fabric adheres more closely to the supporting surface. If the spray point is too close to the supporting surface a non-woven fabric is not produced and instead a film can form. Preferably, the distance between the spray point and the supporting surface is greater than 10 cms, more preferably greater than 30 cms. It has been found that if the amount of diluent is increased the optimum spraying distance increases. Similarly, likewise, as the boiling point of the diluent increases the optimum spraying distance increases.

When the spray point is further away from the supporting surface the non-woven fabric which forms is easily peeled from the support surface so that the fabric remains as a coherent layer. Preferably, the non-woven fabric is easily separated from the supporting surface.

The velocity of the composition when it leaves the spray point and when it arrives at the supporting surface can also affect the resulting fabric.

The methods and compositions of the invention may be used for a wide range of applications, some of which are listed below:

1. Spray on embroidery for clothing and furniture
2. Seamless clothing: if a pair of trousers (for example) is sprayed onto a mould and unpeeled from the mould there will be no seams in the final garment.
3. Millinery, where hats can be made by spraying fabric to a mould, this would make the production considerably cheaper
4. Joining and repairing fabrics/clothing
5. Direct spraying onto the human body e.g. tattoos, visible perfume, scratch and sniff
6. Lining for garments
7. Producing 'smart' clothing e.g. a jacket with a mobile phone incorporated to it by spraying over the 'smart'device, for example
8. Sportswear, e.g. spray on ankle, knee supports etc
9. Bandages e.g. burns bandages or fracture casts
10. Controlled release patches, such as nicotine patches, insulin patches, spray-on patch for menopause, spray-on patch for contraceptive
11. Applying a fabric feel to hard surfaces, such as plastics, wood, metal etc.
12. Laminating
13. Finishing
14. Embossing
15. Adhesives
16. Bonding or holding items against clothing or skin e.g. sensors (thermal sensors or to protect from UV light), or microchips
17. Home furniture, car interiors, planes, hospitals and military applications etc
18. Covering membrane garments and a multitude of other structures from a bra to a temporary tent for example
19. Other applications could include using the technology as an instant cleaning product without using the process of the washing machine and as a solar power spray to charge technology in garments.

20. Spray-on fabric can be charged with a battery or from electric power to make the non woven fabric conductive for a period of time.

21. Spray-on fabric technology can be sprayed by spray-jet for industrial applications (e.g. J-cloths, shoe-shine cloths etc.) and also can be used in computerised ink-jet printers for any surfaces: fabrics, paper, hard surfaces etc 22. The technology can be used in conjunction with other additives of formulations, such as Particles
Absorbing UV particles
Metal powder
Anti-bacterial agents
Sun screens
Fragrances
Pigment and dyes
Lotions transferred to the skin to moisture and heal etc.

23. Can also be used for the following technologies:

Polymer technology
Nano-technology
Bio-chips
Medical
Composites
Tissue engineering The following is a discussion of some of the possible applications of non-woven spray-on fabric Textile Design Applications Spray-on fabric can also be used to create fabric effects on other fabrics or directly onto the skin. Depending on the thickness of the applied layer, customised degrees of transparency and opacity can be obtained, and the same spray can be used for winter or summer clothing.

Depending on the concentration of suspended fibres, and in the size and design of the spray nozzle, the fabric can be diffused in various ways from thin jets to dispersed clouds of varying density.

It can also be used to simulate embroidery, to provide multiple surfaces giving 3D and embroidery effects.

Fashion Design Applications

Spray-on fabric can be used as a substitute for hand sewing. Its flexible and innovative nature makes it a very attractive product for "haute couture", allowing the production of sophisticated instant garments and details. For example it can be used to create collars, pockets and embedding of beads, sequences or crystals, reducing drastically the production times and the costs of garments.

High street fashions can also benefit from spray-on fabric applications. It can help bridge the gap between costly and exclusive hand-sewn couture pieces, and mass produced clothing. High street customers will have a wider choice when buying. They might acquire a designer's item that already incorporates spray-on fabric, or buy a standard item and customise it using the spray themselves. Time consuming ornamental techniques can be revolutionised by the spraying techniques. Also, clothes from different seasons can be updated easily and at a low cost, an important feature for a society that is demanding more sustainable forms of consumption.

Applications: Instant pockets, sleeves, easily removable and re-locatable fastening and sealing pockets, jackets, etc, ornamental techniques (embedding, embroidery).

Manufacturing Uses

Most techniques used in clothing manufacturing can be recreated by the applications of spray-on fabric. The development of the product takes into account the way in which garments, are constructed, with the view to quicken and simply the manufacturing of clothes. Some of the ways in which spray-on fabric can be used to substitute or complement current techniques are outlined below.

Design

Spray-on fabric can be used by fashion designers as a 3-D sketch tool in conjunction with traditional sketching techniques, such as hand drawing, computer graphics. It can revolutionise the making of scale models, allowing work directly on mannequins, in life-size and getting the real feel of fabric.

Pattern

The making of patterns can be speeded up by spraying the fabric directly onto a mannequin or a model, and then simply peeling it off. Using the spray for pattern making can make the need for paper patterns redundant, as the peeled off pattern functions both as a pattern and a toile.

Fitting & Correction of Patterns

During fittings, different sections of the garment can be worked on without resorting to pins and sewing. This would not only mean a speeding up of the fitting process, but it is also a mich more flexible and creative way of rearranging sections and details. Using spray-on fabric for fittings gives designers a chance to introduce substantial changes to a garment, past the design stage.

Spray-on fabric also allows the amalgamation of pattern and toile into one, turning fitting and correction of patterns into a single combined task.

Construction of the Garment

The process of interlining can be improved with the application of spray-on fabric. Interlinings between the top cloth and the inside lining are used to keep the shape of the garment, but also to reinforce, layer or insulate. Any material or garment could be interlined with a felt-like spray-on fabric.

Interfacing can be simplified by the application of thicker layers of spray-on fabric to selected parts such as collars and cuffs.

Spray-on can be used in several ways for binding. It can be function simply as an adhesive material, holding the top cloth, padding and lining together, but also as a padding material in its own right. The spray-on fabric solution can be made water-resistant, anti-static or flame-resistant, increasing its versatility and functionality as an interlining material.

Other possible applications include making garments with embedded electronic devices such as telecommunication devices, body state sensors, or different kinds of transducers; making garments including heating elements, and producing fabrics which have electrically conducting or "touch sensitive" properties.

EXAMPLES

Some embodiments and applications of the invention will now be described by way of example. Generally the fibre lengths given and the molecular weight of polymers are those quoted by the supplier.

Ethyl Acetate as Solvent

A first formulation of the spray-on fabric designed to be easily separated from a surface onto which it is sprayed is as follows:

| | | |
|---|---|---|
| Solvent: | Ethyl acetate | 38.5 g |
| Binder: | Poly vinyl acetate PVA (Mw 140.000) | 4.0 g |
| Fibres: | Cellulose powder (length of fibres = 0.02-0.15 mm) | 4.4 g |
| Adhesive: | Spray contact (3M photo mount 520 400 ml/260 g) | 1 g |
| Other | Food dye | 2 g |

Firstly the ethyl acetate is poured into a glass container after which the spray contact adhesive is added. The solution is then stirred for a few minutes until the acetate is completely dissolved. Then the PVA is added and stirred for one hour until it is completely dissolved. Subsequently the food dye is added and the mixture is allowed to stir for a few minutes. Finally the Cellulose powder is added and stirred for 45 minutes to obtain a homogeneous mixture. This will give a mixture that can be applied on a surface with a two-fluid spray gun (the other fluid in this case being air), an aerosol can, or an artist's air brush.

The assessment of a formulation's quality was made on the basis of parameters such as finish, texture and applicability.

When this formulation is sprayed on a surface it has good cohesive properties, which allows the embedding of other materials for example, feathers. After drying, this material can be readily separated from the surface to which it is sprayed, but if it is required to adhere to a surface the amount of spray contact photo-mount adhesive can be increased to about 4 g.

Acetone as Solvent

An alternative formulation, for forming a fabric which is intended to be permanently adhered to a surface, is as follows:

| | | |
|---|---|---|
| Solvent: | Acetone | 38.5 g |
| Binder: | PVA (Mw 140.000) | 6.5 g |
| Fibres: | Cellulose powder (length of fibres = 0.02-0.15 mm) | 4.9 g |
| Adhesive: | Epoxy resin (Epikote 1004) | 0.1 g |

Firstly the acetone is poured into a beaker and the Epikote epoxy resin is added and subsequently stirred for 40 minutes. When the Epikote epoxy resin is dissolved in the acetone giving a homogeneous solution, the PVA is added. This mixture is stirred for at least one hour to dissolve the PVA. Finally the cellulose powder is added and this mixture is stirred for another hour to obtain a homogeneous solution that is suitable to spray with a two-fluid spray gun, an aerosol can or an artist's air brush.

When this formulation has dried completely it adheres well to a fabric support surface.

In reaching this composition, other compositions of the same mixture were investigated, as set out below:

An alternative composition to the above is shown below:

| | | |
|---|---|---|
| Solvent: | Acetone | 38.5 g |
| Binder: | PVA (Mw 140.000) | 6.5 g |
| Fibres: | Cellulose powder (length of fibres = 0.02-0.15 mm) | 4.4 g |
| Adhesive: | Epoxy resin (Epikote 1004) | 0.6 g |

As with the previous composition, this formulation adhered well to a piece of denim when sprayed, forming a fabric-like covering on the denim surface.

Other formulations were prepared by mixing the components and stirring them on a magnetic stirrer for over an hour, as set out below:

| Acetone (g) | PVA Mwt (g) | Cellulose (g) | Epikote (g) | Comments |
|---|---|---|---|---|
| 38.5 | 6.5 | 4.4 | 0.6 | Gave a nice uniform fabric like finish. Well adhered |
| 38.5 | 4 | 4.4 | 0.6 | Gave a fabric with an appearance of tissue paper Well adhered |
| 38.5 | 3 | 4.4 | 0.6 | Gave a softer more uniform, less feathery fabric Well adhered |
| 38.5 | 2 | 4.4 | 0.6 | Rather non-uniform feathery fabric formed. Well adhered |
| 38.5 | 1 | 4.4 | 0.6 | Rather similar to 2.0 g PVA |
| 38.5 | 0.5 | 4.4 | 0.6 | Nice uniform appearance. Rather unfabric like though. Well adhered |
| 38.5 | 0 | 4.4 | 0.6 | Nice uniform appearance. Rather unfabric like though. Well adhered |
| 38.5 | 6.5 | 4.4 | 0.2 | Coarse fabric appearance. Well adhered |
| 38.5 | 6.5 | 4.4 | 0.1 | Coarse fabric like appearance, rather fragile |
| 38.5 | 6.5 | 4.4 | 0.05 | Fragile, but tissue like, soft feel |
| 38.5 | 6.5 | 4.4 | 0.025 | Still fragile and soft, easily separated form denim |
| 38.5 | 13 | 8 | 0.6 | A stiff product formed, Rather hard, it breaks and cannot be separated from the denim |
| 38.5 | 16 | 2 | 0.6 | Similar to example above |
| 38.5 | 6.5 | 0 | 0.6 | Gave a smooth surface, some fabric like character, rather stretchy. Well adhered |
| 38.5 | 0 | 4.4 | 0.6 | Rough texture, like sandpaper, formulation tended to block nozzle, not nice |
| 38.5 | 6.5 | 4.3 | 0.5 | Resultant coating and the feel of stiff tissue paper, fairly flexible a reasonable result |
| 38.5 | 6.5 | 4.8 | 0.2 | Reasonably flexible material but does crack eventually. Texture is rather rugged (brush-like) |
| 38.5 | 6.5 | 4.7 | 0.3 | Soft like stiff chiffon. Material that hangs over the edge of the substrate is rather flexible. |
| 38.5 | 6.5 | 4.6 | 0.4 | Adheres strongly to the substrate. Considerably stiffer with natural look. Reminiscent of cotton |
| 38.5 | 6.5 | 4.5 | 0.5 | Fragile. Adheres quite strongly to substrate and has a cobweb-like appearance |

-continued

| Acetone (g) | PVA Mwt (g) | Cellulose (g) | Epikote (g) | Comments |
|---|---|---|---|---|
| 38.5 | 6.5 | 4.9 | 0.1 | Strongly adhered to the fabric. Very homogeneous and flexible with a texture that was markedly different to the others paper-mache |

Natural Latex as Binder

Natural latex was considered as an alternative to PVA. The PVA was wholly or partly replaced by a natural latex, as shown below:

| Acetone (g) | PVA Mwt (g) | Latex (g) | Cellulose (g) | Comment |
|---|---|---|---|---|
| 38.5 | 0 | 6.5 | 4.4 | Smooth surface no cracks very flexible, non-fabric like |
| 38.5 | 4.9 | 6 | 4.4 | More fabric like, some flexibility |
| 38.5 | 2 | 4.5 | 4.4 | Similar to plain latex, very flexible |
| 38.5 | 3 | 3.5 | 4.4 | More fabric like, some flexibility |
| 38.5 | 4 | 2 | 4.4 | Same as above |
| 38.5 | 5 | 1 | 4.4 | More fabric like but sample more brittle and fractures on bending, tending to peel off |
| 38.5 | 6.5 | 0 | 4.4 | Fragile and soft, easily separated from denim |

Methanol as Solvent

| Methanol (g) | PVA (Mwt (g) | Cellulose (g) | Comment |
|---|---|---|---|
| 40 | 5 | 4 | Even film produced but surface texture not ideal |
| 30 | 5 | 4 | As above, texture not very good |
| 30 | 10 | 8 | Uneven film |

Poly Vinylbutyrate (PVB) as Binder

Further experiments were conducted where PVA was replaced by poly vinylbutyrate (PVB).

39 g of 5% poly vinylbutyrate (PVB) solution was mixed with Epikote (0.2 g) and 4.4 g of cellulose powders (length of fibres=0.02-0.15 mm). When this was sprayed on to denim, it caused the fabric to roll up a bit. This has not been observed for other compositions. The surface was rough like sand paper.

The invention claimed is:

1. A composition for forming a fabric by spraying onto a supporting surface, the composition before being sprayed comprising pre-spray fibers, a binder and a diluent in which the binder is dissolved and the pre-spray fibers are dispersed and wherein the diluent has a boiling point of not more than 70° C.; wherein the composition is sprayable and, upon being sprayed onto the supporting surface, forms the fabric, wherein the fabric comprises conjugated fibers that are longer than the pre-spray fibers from which the conjugated fibers were formed.

2. A composition according to claim 1, wherein the binder is a polymer.

3. A composition according to claim 1, wherein the binder has a glass transition temperature (Tg) of at least 15° C.

4. A composition according to claim 3, wherein the binder has a glass transition temperature of not more than 200° C.

5. A composition according to claim 1, wherein the binder has a molecular weight of from 15 000 to 200 000.

6. A composition according to claim 1, wherein the binder is selected from the group consisting of: poly vinylacetate, poly vinylbutyrate, natural latex, and poly vinylalcohol.

7. A composition according to claim 1, wherein at least 80% of the pre-spray fibers have a length of at least 0.02 mm.

8. A composition according to claim 1, wherein at least 80% of the pre-spray fibers have a length not more than 10 mm.

9. A composition according to claim 1, wherein substantially all the pre-spray fibers have a length in the range 0.02 to 0.15 mm.

10. A composition according to claim 1, wherein the pre-spray fibers comprise at least 40% polymeric fibers.

11. A composition according to claim 1, wherein the ratio of pre-spray fibers: binder is in the range 5:1 to 1:5.

12. A composition according to claim 1, wherein the diluent is non-toxic.

13. A composition according to claim 1, wherein the composition additionally comprises at least one agent selected from the group consisting of: adhesive, dye, physiologically active ingredient, fragrance, powder, oil, emulsifying agent and propellant.

14. A composition according to claim 1, wherein the composition has a viscosity in the range 10 mPas to 10 Pas.

15. The composition of claim 1, wherein when the composition is sprayed through a nozzle with a diameter of 0.05 to 2 mm onto the supporting surface, the fabric is formed.

16. A composition according to claim 1, wherein the conjugated fibers are at least 1 mm.

17. A non-woven fabric produced by spraying a composition according to claim 1, wherein the fabric comprises conjugated fibers that are formed by bonding the pre-spray fibers together.

18. A fabric according to claim 17, wherein the conjugated fibers lie in parallel with the plane of the supporting surface.

19. An article comprising a non-woven fabric according to claim 17.

20. An article according to claim 19, wherein the article is selected from the group consisting of: a piece of clothing, furniture and millinery item.

* * * * *